US006276129B1

(12) United States Patent
Booth et al.

(10) Patent No.: US 6,276,129 B1
(45) Date of Patent: Aug. 21, 2001

(54) METHOD FOR CONTROLLING AIR/FUEL MIXTURE IN AN INTERNAL COMBUSTION ENGINE

(75) Inventors: Richard Andrew Booth, Canton; Brent Edward Sealy, Dearborn; Kenneth John Behr, Farmington Hills; Michael John Cullen, Northville, all of MI (US)

(73) Assignee: Ford Global Technologies, INc., Dearborn, MI (US)

( * ) Notice: Subject to any disclaimer, the term of this patent is extended or adjusted under 35 U.S.C. 154(b) by 0 days.

(21) Appl. No.: 09/488,417

(22) Filed: Jan. 20, 2000

(51) Int. Cl.[7] ..... F01N 3/00
(52) U.S. Cl. ..... 60/274; 60/285; 60/276
(58) Field of Search ..... 60/274, 276, 285, 60/277

(56) References Cited

U.S. PATENT DOCUMENTS

| | | | |
|---|---|---|---|
| 5,074,113 | 12/1991 | Matsuoka . | |
| 5,207,057 | 5/1993 | Kayanuma . | |
| 5,228,287 | 7/1993 | Kuronishi et al. . | |
| 5,233,829 | 8/1993 | Komatsu | 60/285 |
| 5,247,793 | 9/1993 | Yamada et al. . | |
| 5,255,512 | 10/1993 | Hamburg et al. . | |
| 5,279,114 | 1/1994 | Kurita et al. . | |
| 5,282,360 | 2/1994 | Hamburg et al. . | |
| 5,359,852 | 11/1994 | Curran et al. . | |
| 5,377,484 | 1/1995 | Shimizu . | |

(List continued on next page.)

OTHER PUBLICATIONS

U.S.P.A. for "Method and System For Compensating For Degraded Pre–Catalyst Oxygen Sensor In A Two–Bank Exhaust System" filed on the same date hereof; Inventors: Booth, et al.

U.S.P.A. for "Method And System For Controlling Air/Fuel Level In Two–Bank Exhaust System" filed on the same date hereof; Inventors: Booth, et al.

U.S.P.A. for "Method And System For Controlling Air/Fuel Level For Internal Combustion Engine With Two Exhaust Banks" filed on the same date hereof; Inventors: Booth, et al.

U.S.P.A. for "Diagnostic System For Detecting Catalyst Failure Using Switch Ratio" filed on the same date hereof; Inventors: Booth, et al.

U.S.P.A. for "Diagnostic System For Monitoring Catalyst Operation Using Arc Length Ratio" filed on the same date hereof; Inventors: Booth, et al.

*Primary Examiner*—Thomas Denion
*Assistant Examiner*—Binh Tran
(74) *Attorney, Agent, or Firm*—John F. Buckert; Allan J. Lippa

(57) ABSTRACT

A method and system for controlling the air/fuel ratio in an internal combustion engine having a first group of cylinders and a second group of cylinders. The first group of cylinders is coupled to a catalyst and at least one oxygen sensor, which provides a first feedback signal. The second group of cylinders is coupled to a catalyst and a post-catalyst oxygen sensor, which provides a second feedback signal. A controller uses the first and second feedback signals to calculate a short-term air/fuel bias value for the second group of cylinders. The controller also calculates a new long-term air/fuel bias value corresponding to the current engine speed and engine. The new long-term air/fuel bias value is based on a previously-calculated long-term air/fuel bias value calculated for the same engine load and speed. A total air/fuel bias value is calculated based on the short-term air/fuel bias value and the long-term air/fuel bias value. The new long-term air/fuel bias value is stored for future calculations.

12 Claims, 4 Drawing Sheets

U.S. PATENT DOCUMENTS

| | | | |
|---|---|---|---|
| 5,394,691 | 3/1995 | Seki . | |
| 5,417,058 | 5/1995 | Shimizu . | |
| 5,450,837 | 9/1995 | Uchikawa . | |
| 5,485,382 | 1/1996 | Seki et al. . | |
| 5,492,106 | 2/1996 | Sharma et al. . | |
| 5,511,377 | 4/1996 | Kotwicki . | |
| 5,570,574 | 11/1996 | Yamashita et al. | 60/276 |
| 5,657,625 * | 8/1997 | Koga et al. | 60/274 |
| 5,704,339 | 1/1998 | Choe et al. . | |
| 5,706,793 | 1/1998 | Orzel et al. . | |
| 5,749,221 | 5/1998 | Kawahira et al. . | |
| 5,894,727 | 4/1999 | Zimlich . | |
| 5,899,062 | 5/1999 | Jerger et al. . | |
| 6,112,731 * | 9/2000 | Linenberg et al. | 123/690 |

* cited by examiner

METHOD FOR CONTROLLING AIR/FUEL MIXTURE IN AN INTERNAL COMBUSTION ENGINE

TECHNICAL FIELD OF THE INVENTION

The present invention relates generally to electronic control of an internal combustion engine. In particular, this invention relates to a method of controlling the air/fuel ratio in an engine coupled to a two-bank, three-EGO sensor exhaust system based on a feedback signal derived from at least one of the EGO sensors in the first bank, a feedback signal derived from an EGO sensor in the second bank, and a stored feedforward long-term air/fuel bias value.

BACKGROUND

To meet current emission regulations, automotive vehicles can regulate the air/fuel ratio (A/F) supplied to the vehicles' cylinders so as to achieve maximum efficiency of the vehicles' catalysts. For this purpose, it is known to control the air/fuel ratio of internal combustion engines using an exhaust gas oxygen (EGO) sensor positioned in the exhaust stream from the engine. The EGO sensor provides a feedback signal to an electronic controller that calculates A/F bias values over time. The calculated A/F bias values are used by the controller to adjust the A/F level in the cylinders to achieve optimum efficiency of the corresponding catalyst in the exhaust system.

It is also known to have systems with two EGO sensors in the exhaust stream in an effort to achieve more precise A/F control with respect to the catalyst window. Normally, a pre-catalyst EGO sensor is positioned upstream of the catalyst and a post-catalyst EGO sensor is positioned downstream of the catalyst. Finally, in connection with engines having two groups of cylinders, it is known to have a two-bank exhaust system coupled thereto where each exhaust bank has a catalyst as well as pre-catalyst and post-catalyst EGO sensors. Each of the exhaust banks corresponds to a group of cylinders in the engine. The feedback signals received from the EGO sensors are used to calculate total f/a bias values in their respective group of cylinders at any given time. The controller uses these total f/a bias values to control the amount of liquid fuel that is injected into their corresponding cylinders by the vehicle's fuel injectors.

It is also known in the art for the total f/a bias value to be comprised of two components: a short-term fuel trim value and a long-term fuel trim value. The short-term fuel trim value for a particular group of cylinders is calculated based on the feedback signals from the two EGO sensors in the corresponding exhaust bank. The short-term fuel trim value facilitates a "micro" or gradual adjustment of the A/F level in the cylinders. An example of a method used to gradually adjust the A/F level in a group of cylinders is the well-known "ramp, hold, jumpback" A/F control method described in U.S. Pat. No. 5,492,106, the disclosure of which is incorporated herein by reference. The long-term fuel trim value for a particular group of cylinders is a "learned" value corresponding to particular engine parameters and stored in a data structure for retrieval by the controller. The long-term fuel trim value is calculated based on a corresponding short-term fuel trim value and a previously-calculated long-term fuel trim value. The long-term fuel trim value facilitates "macro" A/F adjustments, which increases the A/F adjustment rate in the cylinders during times of abrupt changes in certain engine parameters, such as engine load and/or engine speed.

Sometimes, in a two-bank, four-EGO sensor exhaust system, one of the pre-catalyst EGO sensors degrades. In other circumstances, it is desirable to purposely eliminate one of the pre-catalyst EGO sensors in a two-bank system to reduce the cost of the system. In either event, it is desirable to continue to be able to adjust the A/F level in the group of cylinders coupled to the exhaust bank having only one operational EGO sensor by using both short-term and long-term fuel trim values, wherein the short-term and long-term fuel trim values are calculated from the feedback signals received from just the three operational EGO sensors alone. However, known methods for A/F adjustment require a matched set of pre-catalyst and post-catalyst EGO sensors in each bank, such as in a one-bank, two EGO sensor system or in a two-bank, four EGO-sensor system.

Accordingly, it is desirable to have a new method of adjusting the A/F level in an engine coupled to a two-bank three-EGO exhaust sensor system using both short-term and a long-term fuel trim values, both of which are calculated from the feedback signals of three EGO sensors instead of four.

SUMMARY OF THE INVENTION

The present invention is directed toward a new method and system for adjusting the A/F level in an internal combustion engine having two groups of cylinders, wherein the first group of cylinders is coupled to a two-EGO sensor exhaust bank and the second group of cylinders is coupled to an exhaust bank having only a post-catalyst EGO sensor. The invention is equally applicable to an engine having two groups of cylinders where the first group is coupled to a catalyst and a pre-catalyst EGO sensor and the second group is coupled to a catalyst and a post-catalyst EGO sensor. Moreover, the invention is applicable to an engine having two groups of cylinders coupled to a two-bank, four-EGO sensor exhaust system where the pre-catalyst EGO sensor in one of the banks degrades.

According to an embodiment of the invention, an electronic controller, in cooperation with fuel injectors, controls the level of liquid fuel injected into first and second groups of cylinders based on corresponding calculated total f/a bias values. For each group of cylinders, the controller calculates each total f/a bias value based on a short-term fuel trim value and a long-term fuel trim value. For the first group of cylinders, the short-term fuel trim value is calculated according to one of several well-known methods based on feedback signals from a corresponding pre-catalyst EGO sensor or from both a pre-catalyst EGO sensor and a post-catalyst EGO sensor, depending upon the embodiment of the invention. Several methods to calculate a short-term fuel trim value based on feedback signals from a pre-catalyst EGO sensor or both pre-catalyst and post-catalyst EGO sensors are known in the art, and the present invention is not dependent upon any one of those methods in particular. For the second group of cylinders, the short-term fuel trim value is calculated based on the feedback signals derived in the first bank and a feedback signal generated by the post-catalyst EGO sensor in the second exhaust bank.

The long-term fuel trim value component of the total f/a bias value is a "learned" value corresponding to a particular engine load and engine speed. Two logical data tables, one corresponding to each group of cylinders, are used to store the "learned" long-term A/F values. For each engine load and engine speed combination, corresponding long-term fuel trim values are stored in the two logical data tables.

The controller uses the combination of the short-term fuel trim values and the long-term fuel trim values to make the A/F adjustment in the corresponding cylinders in two-bank three-EGO sensor exhaust systems more responsive during times of abrupt changes in engine operating parameters, while, at the same time, avoiding unstable oscillations of the system.

DETAILED DESCRIPTION OF THE PREFERRED EMBODIMENT

Figure 1:
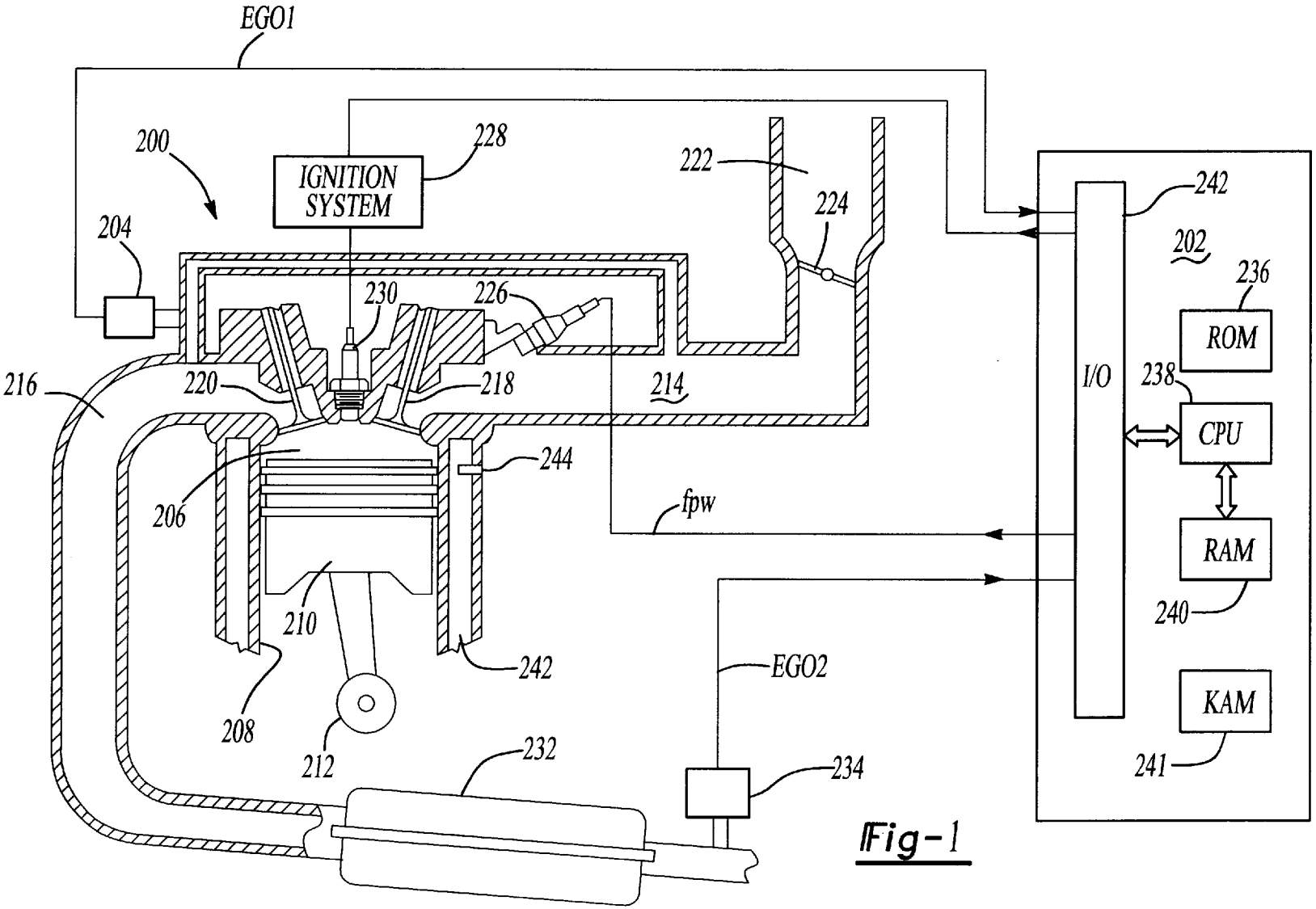
FIG. 1 illustrates an internal combustion engine, according to an embodiment of the invention.

FIG. 1 illustrates an internal combustion engine. Engine 200 generally comprises a plurality of cylinders, but, for illustration purposes, only one cylinder is shown in FIG. 1. Engine 200 includes combustion chamber 206 and cylinder walls 208 with piston 210 positioned therein and connected to crankshaft 212. Combustion chamber 206 is shown communicating with intake manifold 214 and exhaust manifold 216 via respective intake valve 218 and exhaust valve 220. As described later herein, engine 200 may include multiple exhaust manifolds with each exhaust manifold corresponding to a group of engine cylinders. Intake manifold 214 is also shown having fuel injector 226 coupled thereto for delivering liquid fuel in proportion to the pulse width of signal FPW from controller 202. Fuel is delivered to fuel injector 226 by a conventional fuel system (not shown) including a fuel tank, fuel pump, and fuel rail (not shown).

Conventional distributorless ignition system 228 provides ignition spark to combustion chamber 206 via spark plug 230 in response to controller 202. Two-state EGO sensor 204 is shown coupled to exhaust manifold 216 upstream of catalyst 232. Two-state EGO sensor 234 is shown coupled to exhaust manifold 216 downstream of catalyst 232. EGO sensor 204 provides a feedback signal EGO1 to controller 202 which converts signal EGO1 into two-state signal EGOS1. A high voltage state of signal EGOS1 indicates exhaust gases are rich of a reference A/F and a low voltage state of converted signal EGO1 indicates exhaust gases are lean of the reference A/F. EGO sensor 234 provides signal EGO2 to controller 202 which converts signal EGO2 into two-state signal EGOS2. A high voltage state of signal EGOS2 indicates exhaust gases are rich of a reference air/fuel ratio and a low voltage state of converted signal EGO1 indicates exhaust gases are lean of the reference A/F. Controller 202 is shown in FIG. 1 as a conventional microcomputer including: microprocessor unit 238, input/output ports 242, read only memory 236, random access memory 240, and a conventional data bus.

Figure 2:
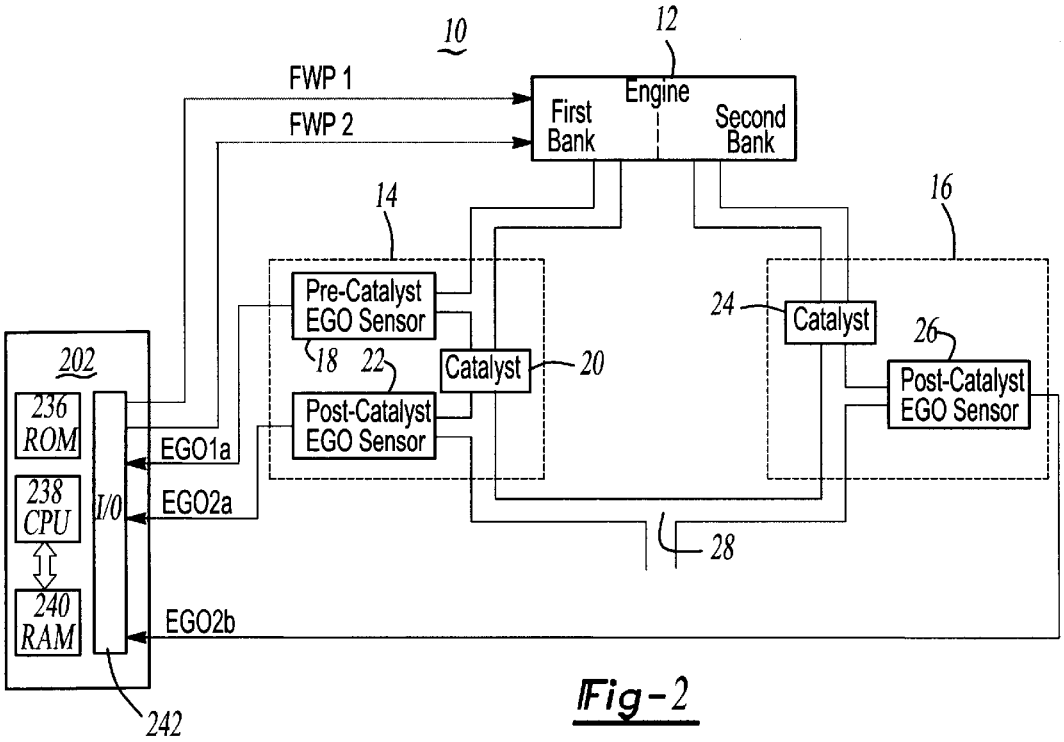
FIG. 2 is a block diagram representing a two-bank exhaust system wherein one bank has a pre-catalyst and a post-catalyst EGO sensor and the other bank has only a post-catalyst EGO sensor, according to an embodiment of the invention.

FIG. 2 schematically illustrates a preferred embodiment of the two-bank exhaust system of the present invention. As shown in FIG. 2, exhaust gases flow from first and second groups of cylinders of engine 12 through a corresponding first exhaust bank 14 and second exhaust bank 16. Engine 12 is the same as or similar to engine 200 in FIG. 1. Exhaust bank 14 includes pre-catalyst EGO sensor 18, catalyst 20, and post-catalyst EGO sensor 22. Exhaust bank 16 includes catalyst 24 and post-catalyst EGO sensor 26. The pre-catalyst EGO sensors, catalysts, and post-catalyst EGO sensors in FIG. 2 are the same as or similar to pre-catalyst EGO sensor 204, catalyst 232, and post-catalyst EGO sensor 234 in FIG. 1.

Figure 3:
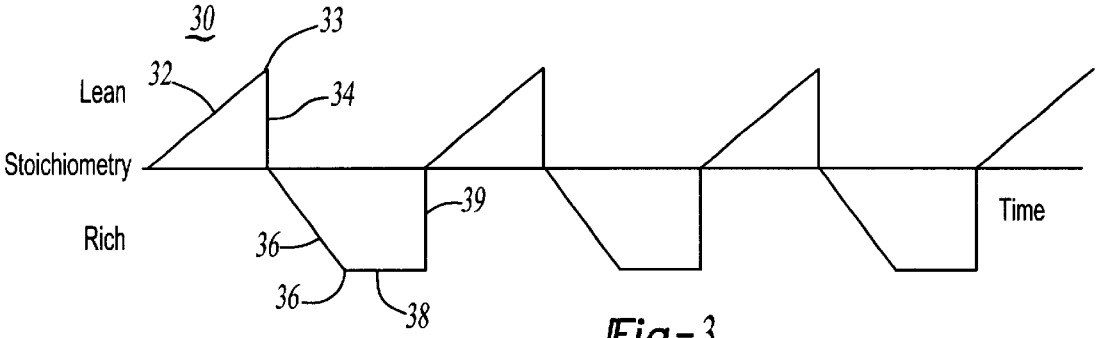
FIG. 3 shows a typical waveform of short-term fuel trim values corresponding to a group of cylinders coupled to an exhaust bank having both a pre-catalyst and a post-catalyst EGO sensor.

In operation, when exhaust gases flow from engine 12 through exhaust bank 14, the pre-catalyst EGO sensor 18 senses the level of oxygen in the exhaust gases passing through bank 14 prior to them entering catalyst 20 and provides feedback signal EGO1*a* to controller 202. After the exhaust gases pass through catalyst 20, the post-catalyst EGO sensor 22 senses the level of oxygen in the exhaust gases subsequent to exiting catalyst 20 and provides feedback signal EGO1*b* to controller 202. With respect to exhaust bank 16, gases flow from the engine 12 through catalyst 24. Subsequent to exiting catalyst 24, post-catalyst EGO sensor 26 senses the level of oxygen in the post-catalyst exhaust gases in bank 16 and provides feedback signal EGO2*b* to controller 202. Then the exhaust gases are joined at junction 28 before being expelled from the system 10, though the disclosed invention is equally applicable to a system wherein the exhaust banks are maintained separate throughout the entire system. Controller 202 used feedback signals EGO1*a*, EGO1*b* and EGO2*b* to calculate preferred A/F values and, in connector with fuel injectors (such as those shown as element 226 in FIG. 1) for each group of cylinders, uses these values to control the amount of liquid fuel that is introduced into the groups of cylinders. The controller shown in FIG. 3 is the same as or similar to controller 202 in FIG. 1.

According to an embodiment of the invention, signals FWPL and FWP2 are generated by controller 202 based on respective total f/a bias values for each group of cylinders. The total f/a bias values are calculated by controller 202 based on respective short-term fuel trim values, long-term fuel trim values, and other calibrated values for each group of cylinders. Specifically, the total f/a bias values are calculated according to the following total f/a bias equation:

Total F/A bias=[Long-term fuel trim(load, speed*Fuel Density Adj.]/[Stoichiometric A/F*Current Short-term fuel trim]

In the Total f/a bias equation above, the Fuel Density Adjustment value is a well-known calibrated value based on the fuel type (gasoline, methanol, diesel, etc.) used in the vehicle and the temperature and pressure in the fuel rails of the fuel system. A Fuel Density Adjustment value of 1.0 would provide no adjustment to the total f/a bias based on fuel type, temperature, and pressure. The stoichimetric A/F value in the total f/a bias equation is a well-known calibrated air/fuel stoichiometric value which depends on the type of fuel used in the vehicle. For gasoline, the Stoichiometric A/F value is approximately 14.6.

For the group of cylinders coupled to exhaust bank 14, the current short-term fuel trim value is calculated by controller 202 based on feedback signals EGO1*a* and EGO1*b*, according any one of a variety of well-known methods, one such method being disclosed in U.S. Pat. No. 5,492,106. The short-term fuel trim value may also be determined based on feedback signal EGO1*a* alone, as is well-known in the art. FIG. 3 shows a waveform 30 that illustrates typical short-term fuel trim values, calculated over time, that are used by controller 202 to oscillate the A/F level in the cylinders around stoichiometry. Waveform 30 represents the desired short-term fuel trim values used to control the A/F level in the group of cylinders corresponding to exhaust bank 14 of FIG. 2. While the A/F waveform 30 shown in FIG. 3 is a preferred A/F waveform for exhaust bank 14, the disclosed invention also is applicable to other A/F waveforms that may be used.

As can be seen from the preferred A/F waveform in FIG. 3, the desired A/F level steadily rises over time, becoming more and more lean, until the EGO sensors detect a lean A/F state in the exhaust. This portion of the A/F waveform is referred to as a ramp portion 32 because the A/F level is being ramped up during this time period. After the EGO sensors detect that the A/F has reached a particular lean threshold value, the A/F is abruptly dropped toward or past stoichiometry. In the preferred embodiments of the invention, the A/F is dropped to a level approximately equal to stoichiometry. This portion of the waveform is referred to as a jumpback portion 34 because of the abrupt return of the A/F toward stoichiometry. Then, the A/F steadily decreases, becoming more and more rich, until the A/F reaches a particular rich threshold value. Similar to when the A/F steadily increases, this portion of the waveform is referred to as a ramp portion 36. Finally, after the EGO sensors detect that the A/F has decreased to a rich A/F state, the A/F is jumped to and held at a particular A/F level that delivers a desired level of rich bias. This portion of the A/F waveform is referred to as a hold portion 38. After the hold portion, the A/F level jumps back 39 toward stoichiometry, and the process is repeated. The A/F waveform 30 depicted in FIG. 3 is typical of typical short-term fuel trim values for a group of cylinders coupled to an exhaust bank having two EGO sensors, like bank 14 of FIG. 2. Controller 202 calculates the desired A/F ramp slope, the jumpback values, and the hold values based on feedback signals EGO1*a* and EGO1*b* received from EGO sensors 18 and 22, respectively.

With respect to the group of cylinders coupled to exhaust bank 16, the known methodologies for calculating preferred short-term fuel trim values are not applicable because they depend upon receiving and utilizing a feedback signal from a pre-catalyst EGO sensor. However, exhaust bank 16 does not have a pre-catalyst EGO sensor. Thus, according to a preferred embodiment of the invention, the short-term fuel trim values for the group of cylinders coupled to bank 16 are calculated by using the short-term fuel trim values generated for bank 14 (using well-known methodologies) and modifying some of them according to feedback signal EG02*b* received from post-catalyst EGO sensor 26. In particular, short-term A/F waveform 40 corresponding to bank 16 utilizes the same ramp portion 32 as that calculated for bank 14. That is, the A/F values for the ramp portions 42, 44 corresponding to bank 16 are copied from the short-term fuel trim values for the ramp portion 32, 36 corresponding to bank 14. Similarly, the short-term fuel trim values for the jumpback portions 43, 46 corresponding to bank 16 are copied from the calculated jumpback portions 34, 39 corresponding to bank 14. However, the hold portion 45 corresponding to bank 16 is calculated based on feedback signal EG02*b* from post-catalyst EGO sensor 26. Feedback signal EG02*b* is used to modify the hold portion 38 corresponding to bank 14 to generate a hold portion 45 corresponding to bank 16.

Figure 4:
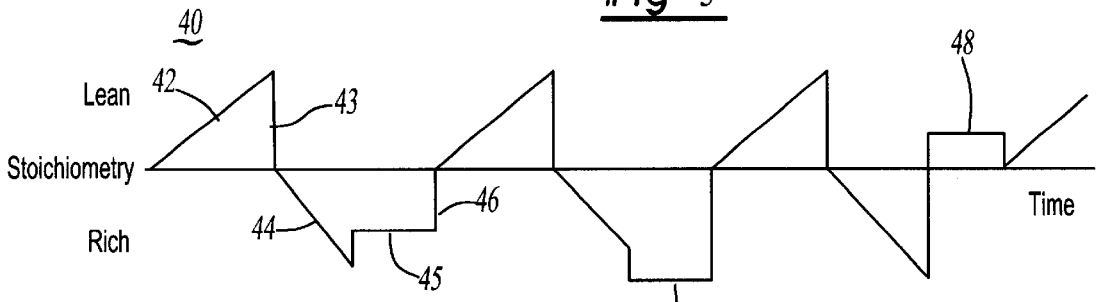
FIG. 4 shows a waveform of short-term fuel trim values corresponding to a group of cylinders coupled to an exhaust bank having just a post-catalyst EGO sensor, according to an embodiment of the invention.

Specifically, the short-term fuel trim value corresponding to the hold portion 45 is generated by adjusting the short-term fuel trim value corresponding to the hold portion 38 either lean or rich, depending upon feedback signal EG02*b*. If feedback signal EG02*b* indicates that the A/F level is too rich in bank 28, then the short-term fuel trim value during the hold portion is adjusted in the lean direction, as shown at 45 in FIG. 4. In some such cases, the A/F adjustment will be large enough so that the short-term fuel trim value during the hold portion passes stoichiometry and is set to a lean bias, as shown at 48 in FIG. 4. If, on the other hand, feedback signal EGO2*b* indicates that the A/F level is too lean in bank 28, then the short-term fuel trim value during the hold portion is adjusted in the rich direction, as shown at 47 in FIG. 4. The amount of A/F adjustment either in the lean or rich direction is determined by controller 202 based on feedback signal EGO2*b*.

Figure 5:
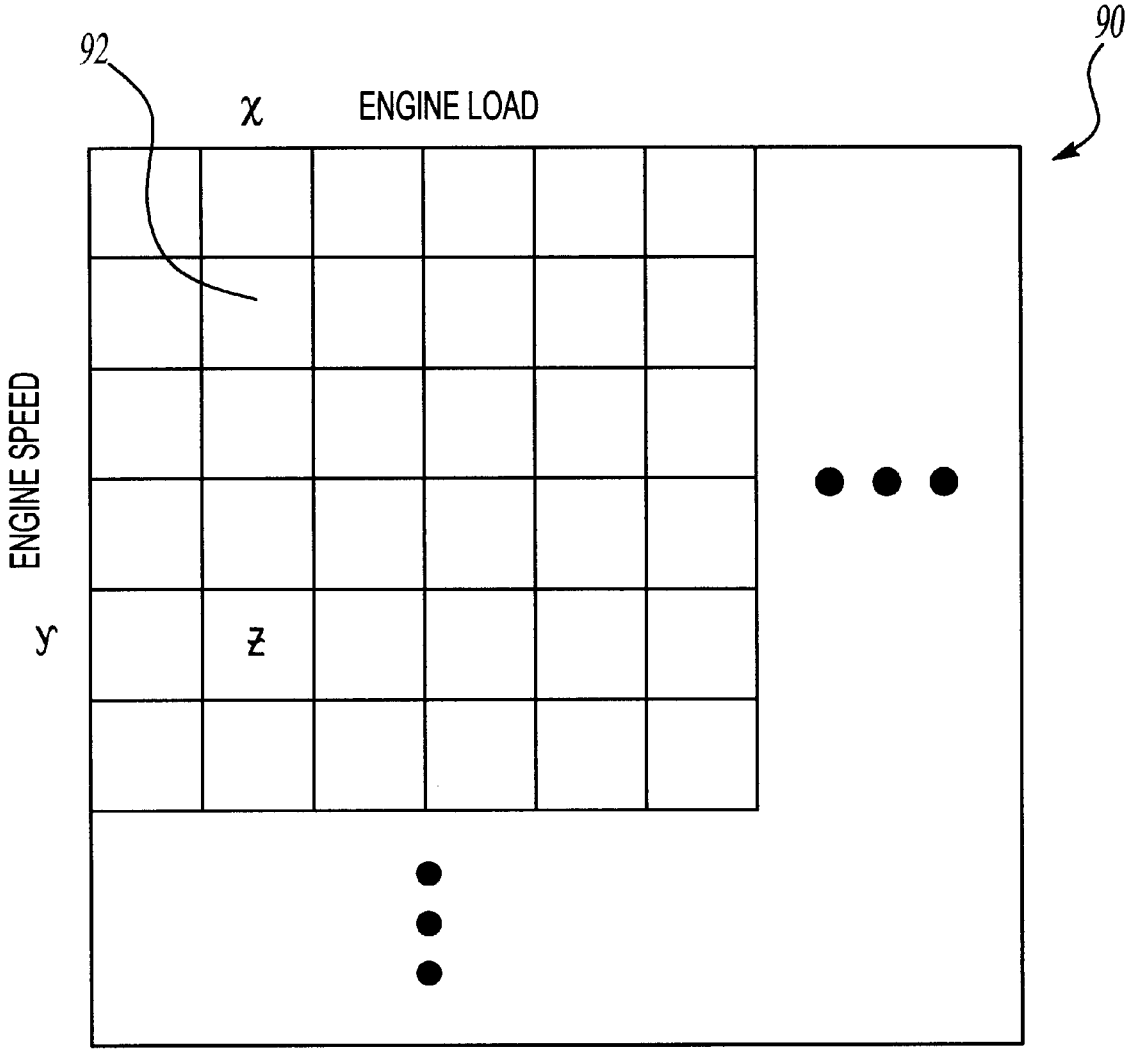
FIG. 5 shows a logical table data structure for storing long-term fuel trim values, according to an embodiment of the invention.

The long-term fuel trim(load, speed) value in the Total f/a bias equation described above is a "learned" value that is read from a two-dimensional logical data table 90 of such values, as shown in FIG. 5. A separate logical table 90 is stored in controller 202 corresponding to each group of cylinders. Each long-term fuel trim value in the logical table corresponds to a particular engine load and engine speed. Accordingly, for purposes of illustration, each long-term fuel trim value is stored in table 90 in a load/speed cell 92 and may be referenced herein as long-term fuel trim(load, speed). At any given engine load and engine speed combination, the corresponding long-term fuel trim value (load, speed) in each table 90 is determined based on (i) the desired A/F level in the corresponding cylinders the last time that the vehicle engine 200 was operated at the same load and speed, and (ii) the current short-term fuel trim value calculated by controller 202 for the corresponding group of cylinders. Therefore, each long-term fuel trim value in each table 90 is "learned" in the sense that it depends from the desired A/F level in the corresponding cylinders during prior instances when the engine 200 was operated under similar load and speed conditions.

The specific method for calculating each long-term fuel trim value is the same for both groups of cylinders, and it consists of the following. First, the current short-term fuel trim value for the particular group of cylinders is compared to a calibrated nominal reference value. As is known in the art, the short-term fuel trim value preferably oscillates around the nominal reference value. For purposes of illustrating an embodiment of the invention, the nominal reference value is chosen to be 1.0. The difference between the current short-term A/F value and the nominal reference value is multiplied by a pre-determined gain value K, and the product is subtracted from the previous long-term fuel trim value stored in the corresponding load/speed cell. The result of this calculation is the new long-term fuel trim value for that particular load and speed. The gain value K can be calibrated from system to system. Generally, a higher gain value K provides a faster A/F adjustment in the cylinders, whereas a lower gain value K provides a slower, but more accurate, A/F adjustment. Preferred gain values K range from 0.05 to 0.10, providing a 5% to 10% gain. Thus, in equation form, the long-term A/F value is calculated by controller 202 as follows:

New Long-term fuel trim(load, speed)=Previous Long-term fuel trim(load, speed)+K*[nominal reference value−current short-term bias value].

By way of illustrating the operation of this equation, we assume that the vehicle is currently operating at a load X and a speed Y, as shown in FIG. 2. We also assume that the previous long-term fuel trim value(x,y) is Z, as shown in FIG. 2. Finally, we assume that the nominal reference value is 1.0. With these assumptions, the new long-term fuel trim equation breaks down to:

New Long-term fuel trim(x,y)=Z+K*[1−current short-term bias value].

In that Z and K are constants, the new long-term fuel trim (x,y) can be determined given a current short-term bias value for the same group of cylinders.

Figure 6:
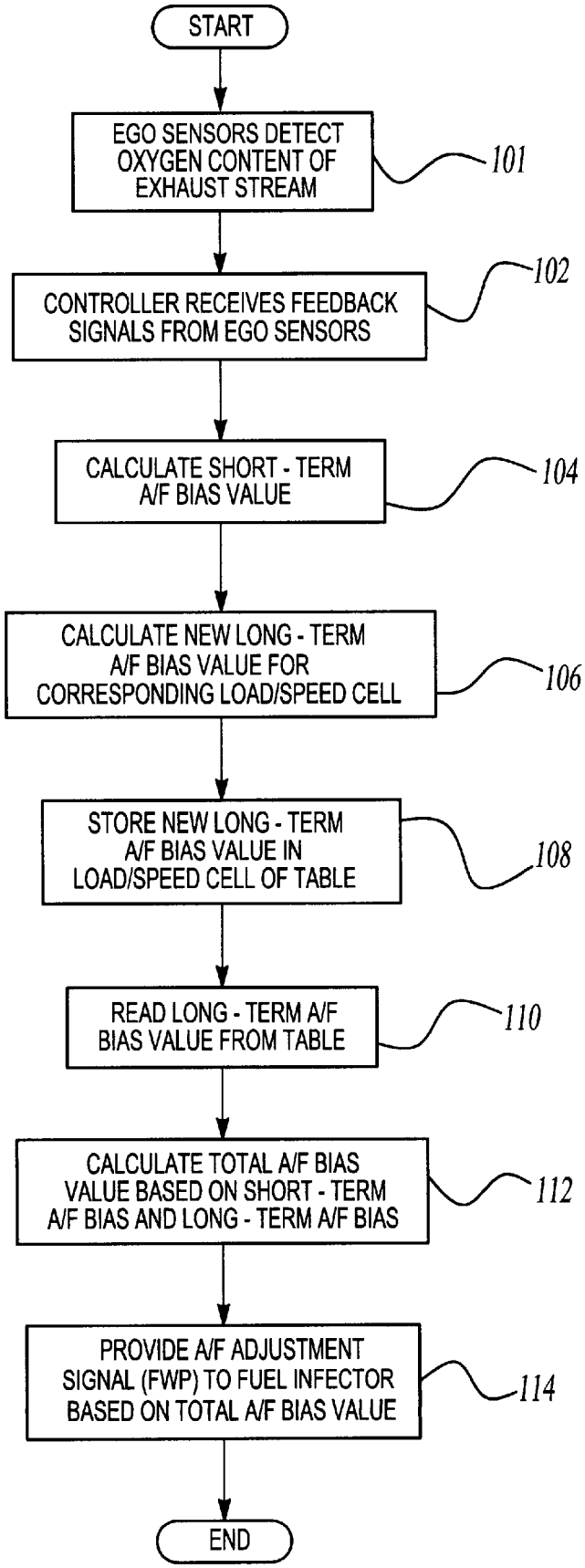
FIG. 6 is a flow-chart of the methodology used to adjust the air/fuel level in the cylinders, according to an embodiment of the invention.

With reference to FIG. 6, a description of a specific embodiment of the invented method is as follows. First, as shown in step 101, EGO sensor 18, EGO sensor 22, and EGO sensor 26 detect the oxygen content of the exhaust gas in their respective exhaust manifolds.

Second, as shown in step 102, the EGO sensors provide feedback signals EGO1*a,* EGO1*b,* and EGO2*b* to controller 202. As shown in step 104, controller 202 calculates current short-term fuel trim values for the two groups of cylinders based on feedback signals EGO1*a,* EGO1*b,* and EGO2*b,* according to the methods described hereinabove.

Next, as shown at step 106, controller 202 calculates a new long-term fuel trim value for each group of cylinders corresponding to the particular engine load and engine speed at which the vehicle is being operated. The new long-term fuel trim values are calculated as described in detail above. Then the new long-term fuel trim values are stored in their respective data tables in controller 202, as shown at step 108. Controller 202 then reads the new long-term fuel trim values from the tables (step 110) and uses the new long-term fuel trim values and the corresponding current short-term fuel trim values to calculate the corresponding total f/a bias values (step 112), according to the total f/a bias value equation described hereinabove. Finally, based on the newly-calculated total f/a bias values, controller 202 provides signals FPW1 and FPW2 to the fuel injectors(step 114). Based on signals FPW1 and FPW2, the fuel injectors provide regulated amounts of liquid fuel to their respective groups of cylinders.

While preferred embodiments of the present invention have been described herein, it is apparent that the basic construction can be altered to provide other embodiments which utilize the processes and compositions of this invention. Therefore, it will be appreciated that the scope of this invention is to be defined by the claims appended hereto rather than by the specific embodiments which have been presented hereinbefore by way of example.

What is claimed is:

1. A method for controlling fuel injection in an engine having a first group of cylinders and a second group of cylinders coupled to a first catalyst and a second catalyst respectively, the method comprising:

generating a first feedback signal from a first EGO sensor coupled to the first catalyst;

generating a second feedback signal from a second EGO sensor located downstream of the second catalyst;

calculating a short-term fuel trim value corresponding to the second group of cylinders based on said first feedback signal and said second feedback signal;

calculating a new long-term fuel trim value corresponding to the second group of cylinders based on a previously-calculated long-term fuel trim value; and adjusting a fuel injection amount into the second group of cylinders based on said short-term fuel trim value and said new long-term fuel trim value.

2. The method of claim 1, further comprising the step of storing said new long-term fuel trim value.

3. The method of claim 2, wherein said new long-term fuel trim value is stored in a data structure wherefrom said new long-term fuel trim value is retrievable based on engine operating parameters.

4. The method of claim 3, wherein said engine operating parameters comprise engine speed.

5. The method of claim 4, wherein said engine operating parameters further comprise engine load.

6. The method of claim 1, wherein said step of calculating a new long-term fuel trim value is further based on said short-term fuel trim value.

7. The method of claim 1, wherein said step of calculating a new long-term fuel trim value is further based on a comparison of said short-term fuel trim value and a calibrated reference value.

8. The method of claim 1, further comprising the step of generating a third feedback signal from a third EGO sensor coupled to the first catalyst; and wherein said step of calculating a short-term fuel trim value is further based on said third feedback signal.

9. A method for controlling fuel injection in an engine having a first group of cylinders and a second group of cylinders coupled to a first catalyst and a second catalyst respectively, the method comprising:

generating a first feedback signal from a first EGO sensor coupled to the first catalyst;

generating a second feedback signal from a second EGO sensor located downstream of the second catalyst;

calculating a short-term fuel trim value corresponding to the second group of cylinders based on said first feedback signal and said second feedback signal;

calculating a new long-term fuel trim value corresponding to the second group of cylinders based on a previously-calculated long-term fuel trim value;

storing said new long-term fuel trim value in a data structure wherefrom said new long-term fuel trim value is retrievable based on engine operating parameters; and adjusting a fuel injection amount into the second group of cylinders based on said short-term fuel trim value and said new long-term fuel trim value.

10. The method of claim 9, wherein said step of calculating a new long-term fuel trim value is further based on a comparison of said short-term fuel trim value and a calibrated reference value.

11. The method of claim 9, further comprising the step of generating a third feedback signal from a third EGO sensor coupled to the first catalyst; and wherein said step of calculating a short-term fuel trim value is further based on said third feedback signal.

12. A system for controlling fuel injection in an engine having a first group of cylinders and a second group of cylinders coupled to a first catalyst and a second catalyst respectively, the system comprising:

a first EGO sensor coupled to the first catalyst for generating a first feedback signal;

a second EGO sensor located downstream of the second catalyst for generating a second feedback signal;

a controller for (i) calculating a short-term fuel trim value corresponding to the second group of cylinders based on said first feedback signal and said second feedback signal; (ii) calculating a new long-term fuel trim value corresponding to the second group of cylinders based on a previously-calculated long-term fuel trim value; and (iii) adjusting a fuel injection amount into the second group of cylinders based on said short-term fuel trim value and said new long-term fuel trim value.

* * * * *